United States Patent [19]

Yonkman et al.

[11] Patent Number: 4,865,282

[45] Date of Patent: Sep. 12, 1989

[54] PAINT ROLLER WIPER WITH PAINTBRUSH HOLDER

[76] Inventors: Robert K. Yonkman; William G. Szakacs, both of 811 N. Main St., Crown Point, Ind. 46306

[21] Appl. No.: 227,166

[22] Filed: Aug. 2, 1988

Related U.S. Application Data

[63] Continuation of Ser. No. 948,222, Dec. 31, 1986, abandoned.

[51] Int. Cl.[4] ..... A46B 17/02

[52] U.S. Cl. ..... 248/111; 15/257.06; 220/90

[58] Field of Search ..... 248/110, 111, 112; 15/257.06, 257.05; 220/90; 211/65, 66

[56] References Cited

U.S. PATENT DOCUMENTS

| | | | |
|---|---|---|---|
| 2,480,541 | 8/1949 | Borelli et al. | 248/111 |
| 2,705,334 | 4/1955 | Farrow | 220/90 X |
| 2,827,648 | 3/1958 | Geisz | 15/121.2 |
| 3,087,190 | 4/1963 | Werner | 15/520 |
| 3,394,425 | 7/1968 | Welt | 15/257.06 |
| 4,083,466 | 4/1978 | McManaway | 220/90 |
| 4,145,789 | 3/1979 | Morgan, Sr. | 248/111 X |
| 4,491,234 | 1/1985 | Wilcock | 220/90 |

*Primary Examiner*—Ramon S. Britts
*Assistant Examiner*—David L. Talbott
*Attorney, Agent, or Firm*—Welsh & Katz, Ltd.

[57] ABSTRACT

A combination paint roller wiper and paintbrush holder comprises a wiping surface with a plurality of hooks to hang the wiping surface in a paint bucket. The wiping surface is connected to a projection that engages the wall of the bucket when a paint roller is wiped on the wiping surface. The combination also includes a support structure for a paintbrush or the like that is attached to the wiping structure on the side opposite from the wiping surface. The support structure may be attached permanently to the wiping portion, or it may be made removable. The bottom portion of the paintbrush holder is made of a solid material with drain holes to support a standing paintbrush without damage to the bristles. The paintbrush holder also has a perforated front wall, perforated side walls and a perforated rear wall.

13 Claims, 1 Drawing Sheet

FIG. 1
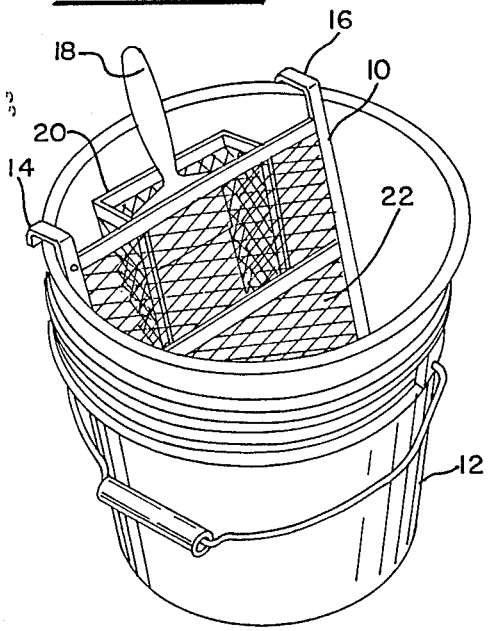
FIG. 2
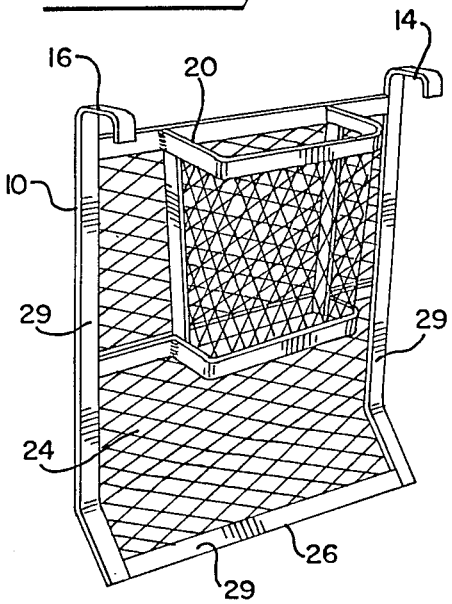
FIG. 5
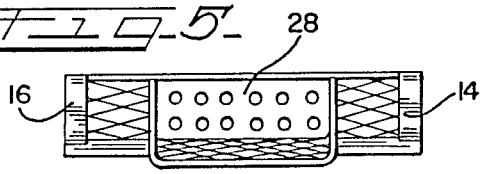
FIG. 3
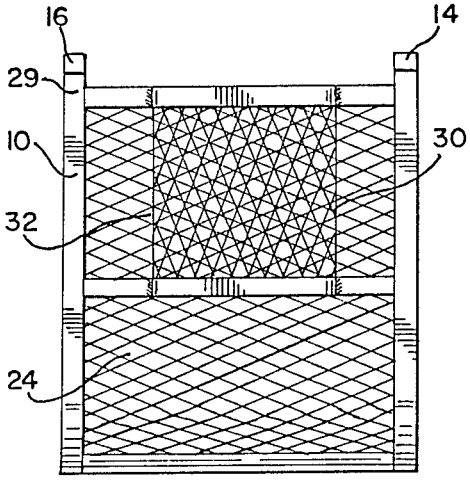
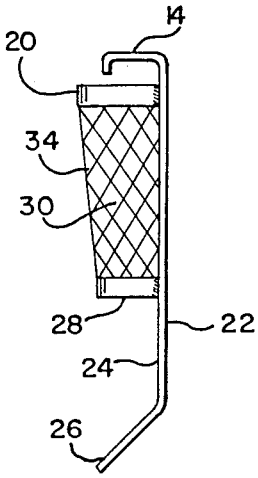
FIG. 4

PAINT ROLLER WIPER WITH PAINTBRUSH HOLDER

This is a continuation of application Ser. No. 948,222, filed Dec. 31, 1986, now abandoned.

BACKGROUND OF THE INVENTION

This invention relates to equipment for painting with rollers. In particular, it is an apparatus for keeping brushes and other auxiliary equipment at hand and ready for use.

Painting walls, ceilings, and other such surfaces with a paint roller is mot readily accomplished by use of the combination of a long-handled roller, a five-gallon paint bucket, and means for wiping or otherwise removing excess paint from a roller after it has been dipped in the paint. Roller wipers are available commercially for use with five-gallon paint buckets. They are typically made to hang in the paint bucket and to present a wiping surface that is above the level of the paint in the bucket. The wiping surface may be of metal or plastic, and it may be open in structure or solid. If it is solid, the surface is normally given ridges or other projections to increase friction on a roller that is being wiped. Particularly good results have been achieved by making the wiping surface of an expanded metal or plastic, which both provides friction for wiping a roller and also permits excess paint to drain through the expanded openings.

While the roller is effective in applying paint efficiently to flat surfaces, almost any paint job also requires the use of brushes, hand rollers, paint mitts, and the like. Brushes in particular are useful for trimming around corners and for feathering at the beginning or end of a painted section. A painter is most efficient when his tools are at hand and ready for use when he needs them. It is common to keep brushes used for trimming, feathering, and the like, in separate small paint buckets. It is also common to keep hand rollers in separate paint trays. This provides the disadvantages of more equipment to move when one portion of the job is completed, and also an increased opportunity for spilling paint if the small bucket or paint tray is knocked over.

SUMMARY OF THE INVENTION

It is an object of the present invention to provide an apparatus for keeping a paintbrush conveniently at hand when using a roller wiper.

It is a further object of the present invention to provide a paint roller wiper with a holder for paintbrushes and the like.

Other objects will become apparent in the course of a detailed description of the invention.

A combination paint roller wiper and paintbrush holder comprises a wiping surface with a plurality of hooks to hang the wiping surface in a paint bucket. The wiping surface is connected to a projection that engages the wall of the bucket when a paint roller is wiped on the wiping surface. The combination also includes a support structure for a paintbrush or the like that is attached to the wiping structure on the side opposite from the wiping surface. The support structure may be attached permanently to the wiping portion, or it may be made removable. The bottom portion of the paintbrush holder is made of a solid material with drain holes to support a standing paintbrush without damage to the bristles.

BRIEF DESCRIPTION OF THE DRAWINGS

FIG. 1 is a perspective view showing the combination wiper and paintbrush holder of the present invention in place in a paint bucket.

FIG. 2 is a perspective view of the combination roller wiper and paintbrush holder of the present invention.

FIG. 3 is a front elevation view of the combination roller wiper and paintbrush holder of the present invention.

FIG. 4 is a side elevation of the combination roller wiper paintbrush holder of the present invention.

FIG. 5 is a top view of the combination roller wiper and paintbrush of the present invention.

DETAILED DESCRIPTION OF THE PREFERRED EMBODIMENT

FIG. 1 is a perspective view of the combination paint roller wiper and paintbrush holder of the present invention. In FIG. 1, the combination roller wiper and paintbrush holder 10 is shown in place in a paint bucket 12, suspended there by hooks 14 and 16. Paintbrush 18 is shown in position in paintbrush holder 20 which is preferably disposed as shown in the same direction as hooks 14 and 16. This frees wiping surface 22 for contact with a paint roller to remove excess paint from the roller. It should be evident that paintbrush holder 20 could equally as well be used to store such equipment as edging rollers, wallpaper brushes, and the like.

FIG. 2 is a perspective view of the combination roller wiper and paintbrush holder of the present invention from the side of paintbrush holder 20. Inner surface 24, the opposite to wiping surface 22, is seen to terminate in projection 26, which is bent to make contact with the inside of paint bucket 12, approximately in line with hooks 14 and 16. Referring to FIGS. 1 and 2, it can be seen that when the combination roller wiper and paintbrush holder 10 is hung in the paint bucket 12 by hooks 14 and 16, it will hang vertically or nearly vertically, and projection 26 will engage the inside of paint bucket 12 to maintain the vertical or near-vertical alignment against any force exerted in wiping a roller. The combined affects of hooks 14 and 16 and projection 26 also serve to keep paintbrush holder 20 from being pushed into contact with the inside of paint bucket 12.

FIGS. 3, 4, and 5 are respectively a front, side, and top view of combination paint roller wiper and paintbrush holder 10. In FIGS. 3, 4, and 5, a brush support surface 28 at the bottom of paintbrush holder 20 appears as a solid piece with drain holes for paint. This is in contrast to the structure that forms wiping surface 22 and inner surface 24. Brush support surface 28 is a predominantly flat surface to support brushes on their bristle tips without damage. Wiping surface 22 and inner surface 24 are made of an expanded metal in the preferred embodiment, although the invention could also be practiced with such surfaces made of an open structure of plastic or the like or of solid structure having ridges or other means for applying friction to a paint roller so as to wipe the roller uniformly. In the preferred embodiment, the edges of the expanded metal or plastic are protected and provided with support by strips 29 of metal or plastic that are folded over the edges and welded or glued. It is also convenient to extend the strips 29 to form hooks 14 and 16. Sides 30 and 32 of paintbrush holder 20 are preferably made of an expanded metal or plastic as is front wall section 34. It is to be noted that the rear wall of the paintbrush holder 20 is also made of expanded metal or plastic since it is, in fact, the inner surface 24 of the wiping surface 22. Thus, pocket 20 has four perforated walls and a perforated bottom plate 28, as clearly shown in the Figures. In the preferred embodiment, side wall sections 30 and 32 are tapered with a trapezoidal shape so that the front wall section 34 slopes inwardly toward the bottom surface 28, as shown in FIG. 4. However, this is not necessary, as paintbrush holder 20 can equally as well be made with four straight sides.

In the preferred embodiment of the present invention, hooks 14 and 16 are separated from each other by at least 9 inches and preferably as much as 10 or 11 inches. This places wiping surface 22 close to the center of paint bucket 12, which typically has an inner diameter of the order of 12 inches. This choice of dimensions permit sides 30 and 32 to have a width of as much as 2 inches at the top without contacting the inside of paint bucket 12.

What is claimed is:

1. A combination paint roller wiper and paintbrush holder for use in a paint bucket, the combination comprising:

(a) a perforated planar wiping section perforated substantially throughout and having a rear side and a front wiping side;

(b) at least two hanging hooks connected to said wiping section for engaging a paint bucket and hanging said wiping section within the paint bucket;

(c) standoff means connected to said wiping section at an angle, said standoff means maintaining said wiping section in an upward position within said bucket;

(d) a pocket secured to an upper central portion of said rear side of said wiping section, said pocket opening upwardly for the reception of a paintbrush; and (e) said pocket having perforated side walls, a perforated front wall, a perforated back wall formed by the rear side of said wiping section, and a perforated bottom plate positioned at said upper central portion of said rear side to provide a brush support surface with drain holes for paint, whereby said pocket permits the support of a paintbrush while at least a portion of the flow of excess paint from a paint roller passing over said wiping side may pass through the wiping section and said pocket at the same time to keep the supported paintbrush from drying out.

2. A combination paint roller wiper and paintbrush holder according to claim 1 wherein said side walls are tapered toward said bottom plate in a trapezoidal configuration, and said front wall slopes inwardly to said bottom plate.

3. A combination paint roller wiper and paintbrush holder according to claim 1 wherein said hanging hooks are perpendicular to the plane of said wiping section.

4. A combination paint roller wiper and paintbrush holder according to claim 1 wherein said standoff means is a perforated standoff section integral with said wiping section.

5. A combination paint roller wiper and paintbrush holder according to claim 4 wherein said standoff section is made of an open mesh.

6. A combination paint roller wiper and paintbrush holder according to claim 1 wherein said wiping section is made of an open mesh.

7. A combination paint roller wiper and paintbrush holder according to claim 1 wherein said pocket side walls, front wall and back wall are made of an open mesh.

8. A combination paint roller wiper and paintbrush holder according to claim 1 wherein said pocket bottom plate is a solid plate containing a plurality of apertures.

9. A combination paint roller wiper and paintbrush holder according to claim 1 wherein said wiping section, said standoff means, said pocket side walls, said pocket front wall and said pocket back wall are made of an open mesh.

10. A combination paint roller wiper and paintbrush holder according to claim 9 wherein said open mesh is an expanded metal or expanded plastic.

11. A combination paint roller wiper and paintbrush holder according to claim 9 wherein said pocket bottom plate is a solid plate containing a plurality of apertures.

12. A combination paint roller wiper and paintbrush holder according to claim 1 wherein said standoff means maintains said wiping section in a near-vertical position.

13. A combination paint roller wiper and paintbrush holder according to claim 1 wherein said standoff means maintains said wiping section in a vertical position.

* * * * *

UNITED STATES PATENT AND TRADEMARK OFFICE

CERTIFICATE OF CORRECTION

PATENT NO. : 4,865,282

DATED : September 12, 1989

INVENTOR(S) : Robert K. Yonkman et al.

It is certified that error appears in the above-identified patent and that said Letters Patent is hereby corrected as shown below:

In column 2, line 14, after "wiper" insert --and--.

Signed and Sealed this

Eleventh Day of September, 1990

*Attest:*

HARRY F. MANBECK, JR.

*Attesting Officer*

*Commissioner of Patents and Trademarks*